US006321760B1

(12) United States Patent
Meissner

(10) Patent No.: US 6,321,760 B1
(45) Date of Patent: Nov. 27, 2001

(54) INDUSTRIAL CLEANING FACILITY

(75) Inventor: Werner Meissner, Marienheide (DE)

(73) Assignee: MOB Maerkische Oberflaechenanlagen & Behaelterbau GmbH, Luckenwalde (DE)

( * ) Notice: Subject to any disclaimer, the term of this patent is extended or adjusted under 35 U.S.C. 154(b) by 0 days.

(21) Appl. No.: 09/355,425

(22) PCT Filed: Jan. 27, 1998

(86) PCT No.: PCT/DE98/00273

§ 371 Date: Oct. 15, 1999

§ 102(e) Date: Oct. 15, 1999

(87) PCT Pub. No.: WO98/33605

PCT Pub. Date: Aug. 6, 1998

(30) Foreign Application Priority Data

Jan. 30, 1997 (DE) ..... 197 03 310

(51) Int. Cl.[7] ..... B08B 3/02

(52) U.S. Cl. ..... 134/80; 15/306.1; 34/76; 34/210; 134/134

(58) Field of Search ..... 134/61, 80, 81, 134/134; 15/303, 306.1, 309.2; 34/76, 79, 209, 210

(56) References Cited

U.S. PATENT DOCUMENTS 3,412,667 * 11/1968 Hunt ..... 134/80 X
3,706,317 12/1972 Fox et al. .

FOREIGN PATENT DOCUMENTS 4125891 2/1993 (DE) .
4220927 1/1994 (DE) .
19509645 9/1996 (DE) .
160362 11/1985 (EP) .
227275 7/1987 (EP) .
368775 5/1990 (EP) .
1780873 * 12/1992 (SU) ..... 134/134

* cited by examiner

*Primary Examiner*—Philip R. Coe
(74) *Attorney, Agent, or Firm*—Jordan and Hamburg LLP

(57) ABSTRACT

The invention relates to an industrial cleaning facility comprising at least one treatment chamber (8) which can be put in an open position or a closed position (operating position). To ensure that the treatment chamber (8) can be loaded and unloaded without difficulty and to permit easy adaptation to a discontinuous production line (2; 3), the treatment chamber is divided up and consists of at least one lower part (13) and at least one upper part (26). The lower parts (13) can be fixed to a rotating column (9) having several arms and the upper parts (26) can be fixed to immovable holding posts (7) and be height-adjustable. In holding stations (7) the upper parts (26) and the lower parts (13) can be connected by means of lifting devices (38) and moved into the operating position.

45 Claims, 3 Drawing Sheets

INDUSTRIAL CLEANING FACILITY

BACKGROUND OF THE INVENTION

The invention relates to an industrial cleaning facility for the surface treatment of objects, especially of processed workpieces, with a treating medium, such as a cleaning liquid, steam, compressed air, heat, vacuum or the like, at least one processing chamber, which for loading and unloading is brought into an opened position and, as working position, is brought into a closed position, being provided for the treatment.

In the U.S. Pat. No. 3,706,317, a facility for washing and rinsing food containers for equipment on board of aircraft or other means of transportation is described. The facility, constructed for continuous operation, contains a washing chamber and a rinsing chamber, which are disposed in a straight row and each of which can be closed off by swinging doors. For transporting the food containers, moveable trailers are provided, which run on rails and, with the help of an endless revolving chain, are pulled in a row consecutively in a certain time cycle, step for step, through the facility. Each trailer of this facility has a hook and the chain has several catches, which are disposed at a distance from another and to which the trailers are hooked. The distance of the catches from one another corresponds precisely to the magnitude of a transporting step of the revolving chain, by means of which a first trailer is transported from the washing chamber into the rinsing chamber and a second trailer is transported into the washing chamber. Each trailer is placed in the center of the respective chamber, so that the doors can be opened or closed. By means of this construction of the facility, the trailers are guided at the chain, so that the required distance can be maintained. The exact positioning of the trailers in the chambers depends on the control of the movement of the chain. In order to be able to operate this facility, an operator must always move back and forth from the loading side to the unloading side, which can still be justified economically in the case of a partial load operation or for a small facility, such as this one without a drying step. For a full load operation or for a large industrial facility, however, the distances, which must be covered from loading to unloading, are so large in the case of such an in-line facility, that the use is not economically feasible.

DE 42 20 927 A1 discloses a continuous cleaning facility, with which washing boxes, which are permeable to the treating medium and disposed consecutively in a row, are taken up. The known cleaning facility has three processing chambers, which are disposed consecutively, namely, a cleaning chamber, a rinsing chamber and a drying chamber. The facility is operated by transporting the container in the cleaning chamber and the container in the rinsing chamber as well as the container in the drying chamber jointly into the next station.

At the inlet and outlet openings of the processing chambers, lids or doors are mounted, with which the chambers can be closed off during the treatment phase.

In order to facilitate the transport of washing boxes from chamber to chamber, rollers and slide rails are mounted in the processing chambers and form a transporting segment. In each processing chamber, a rotation device is installed, which takes up the washing box and can be caused to rotate by a motor in the longitudinal direction of the processing chamber, so that the washing box in the chamber is rotated during the processing phase. For this purpose, the washing box is closed off with a lid, so that the material, being washed, cannot fall out.

The motor for driving the rotation device is mounted at the outer wall of the processing chamber and drives the rotation device over a transmission. Moreover, the operating facilities for the individual processing chambers, such as pumps, valves, dampers, control and regulating equipment are installed at or in the chambers and connected over pipeline networks to the stationary devices of the facilities, such as containers holding cleaning or rinsing agents, distillation equipment and blowers for drying the processed materials.

During the processing phase, the material being processed, through nozzles installed in the cleaning chamber, is exposed to a stream of detergent, with which the materials to be washed are freed from adhering oil-containing or fat-containing processing residues. Rotating the washing basket results in good mixing, so that the detergent can wet all parts of the material to be washed. The processing phase in the rinsing chamber, in which the rinsing nozzles are installed, proceeds similarly. The material to be washed, which is wetted with the detergent solution, is exposed to a flow of rinsing material, which rinses off the detergent residues adhering to the material to be processed. Here also, the rinsing effect is improved by the rotation. Likewise, the rotation of the material to be washed improves the drying process.

The facility is completed with a continuous method for working up the rinsing liquid by distillation, multiple use of the energy given off by the distillation process, for example, for heating the cleaning and/or rinsing liquid or for heating the drying air. In addition, the material being processed can be rinsed by immersion or spraying, blown off with compressed air and dried by vacuum and/or infrared radiation and aqueous or hydrocarbon-containing washing liquids can be used.

The known facility has proven its value in practice. However, the facility can be used effectively only if the material to be processed is filled into special containers, which are permeable to the treating medium. These special containers are, for example, transporting boxes of perforated sheet metal or lattice rods, because normal transporting boxes of sheet metal shield the material from the processing medium, so that there is no intensive contact. Therefore, in the case of the known cleaning facility, the material to be processed, which is brought along in normal transporting boxes, is transferred into appropriate special containers. This is cumbersome and time consuming, because it prevents continuous processing and further processing of the materials.

DE 195 09 645 A1 discloses a washing facility, for which a washing zone and a rinsing zone and a drying zone are disposed in an arc and preferably in a circle and are connected with one another by means of a transporting segment. Furthermore, between the washing zone and the drying zone, a loading and unloading zone are provided, with which a connection is established between the drying zone and the washing zone. Accordingly, objects can be brought to the loading zone onto the transporting segment and are transported in a circle and pass consecutively through the washing, rinsing and drying zones of the facility. Finally, the objects leave the facility once again at the place where they were brought into the facility in a dirty state.

A roller conveyor, disposed in the circle, or a turntable constructed as a screen or grid, on which the objects are transported, serves as transporting segment. Owing to the fact that the objects are brought into the facility at approximately the same place, where they are taken from the facility, one operator is sufficient for loading and unloading. In any case, the work of the operator is made easier, since long distances no longer have to be covered in order to get from the loading area to the unloading area. What applies for the manual operation of the plant, applies of course also for automatic loading and unloading, integration into a manufacturing line being possible. In this case, the manufacturing line itself does not increase in length, because the cleaning facility is set up next to and not spatially within the manufacturing line. Overall, the facility requires little space, so that it can be used even when space conditions are tight, inside or outside, for example, in a corner.

The facility is intended to be operated continuously and not cyclically. Furthermore, the objects cannot be moved while being processed; for example, they cannot be rotated or brought into an oscillating motion in order to experience processing all around with the processing medium. In addition, no support is provided for the objects on the transporting segment, so that the objects, brought onto the conveying segment by means of the conveying and handling equipment, can change their position during the processing, so that the unloading is more difficult than the loading. With the known facility, it is also not possible to flood the chambers with the processing medium in order to be able to immerse the object.

SUMMARY OF THE INVENTION

It is an object of the invention to provide a cleaning facility, which is an improvement with respect to the processing chamber and, in particular, works without closing caps or doors and can be loaded and unloaded easily.

It is an object of the invention to provide an industrial cleaning facility for the surface treatment of objects, especially of processed workpieces, with a treating medium, such as a cleaning liquid, steam, compressed air, heat or the like, at least one processing chamber being provided for the treatment, which is brought into an open position for loading and unloading and into a closed position as a working position, which makes a precisely fixed mode of operation and a reliable functioning of the processing chamber possible, simplifies the handling as well as the transport of the workpieces and improves the loading of the facility.

Pursuant to the invention, this objective is accomplished by means of two alternate cleaning facility embodiments.

The two embodiments relate to the use of the invention for different structural shapes and sizes of cleaning facilities. One embodiments is directed more towards smaller facilities with one or two processing steps, while the other embodiments is directed more to larger facilities, which provide multi-step surface processing, such as, a washing step, a rinsing step and a drying step. Furthermore, additional steps, such as a pre-washing step, a pre-rinsing step or a clean rinsing step can be provided. A separate processing chamber can be provided for each processing step. Such a cleaning facility with many processing steps is advantageously provided for the final cleaning of objects in order, for example, to be able to supply a workpiece to a final installation, while the smaller facility advantageously is used for the intermediate cleaning of workpieces, in order, for example, to free workpieces between two processing steps from coarse processing residues, such as oil, fat, shavings or chips. For this purpose, a small, compact, simply constructed and easily handled facility is created. Pursuant to the invention, such a facility shall contain a stationary sub-assembly, which consists essentially of a stand or a gallows-like mast, at the upper end of which the one part of the processing chamber is rigidly, that is, immovably, attached and can be equipped with facilities, with which the processing medium is distributed over the workpiece. These facilities can be spraying nozzles for a cleaning liquid, or air showers, with which compressed air, with which the workpiece is blasted, is ejected. It is also within the scope of the invention that this facility is formed from steam jet nozzles or heating facilities for drying. This stationary sub-assembly can interact with a mobile sub-assembly, which has a device for transporting the second part of the processing chamber and at least one seat for at least one workpiece. Advantageously, the seat is constructed so that it can be rotated or swivelled or provided with a driving mechanism. The part of the processing chamber, which can be moved with the transporting device, is a lower part; it can be constructed in the form of a tub or a container and is supplemented by the first part of the processing chamber, which is an upper part and can be constructed in the form of a hood. The lower part of the processing chamber can be shifted into a loading and unloading position with the transporting device. In the loading and unloading position, the object, a workpiece to be treated, is inserted into the seat and the two parts (upper part and lower part) are brought into a mutually aligned position and assembled with the transporting device and brought into the working position, in which the processing of the object takes place. When the processing is ended, the lower part and the upper part are separated from one another with the transporting device and the lower part is brought into the loading and unloading position, in which the object can be removed from the lower part. This can be done manually or automatically. The facility can be equipped advantageously with a processing chamber for a processing step. In this case, several such facilities with different processing steps, one of which cleans (wet or dry), another of which rinses and yet another dries, can interact.

In a reverse arrangement, the height of the upper part, which is mounted on the stand or the gallows-like mast, can be adjusted with respect to the lower part, in which case, the lower part can be immobile. Preferably, both parts are mounted movably, namely the upper part can be shifted or swivelled vertically with a lifting device and the lower part horizontally with the transporting device. This has the advantage that the upper part can be separated easily from the lower part even if the processing chamber is constructed pressure-tight or vacuum-tight. For loading and unloading the objects, the upper and lower parts can be shifted laterally to one another, so that the lower part can be loaded and unloaded conveniently. Objects, which protrude beyond the edge of the lower part, also do not hinder the assembly of the processing chamber.

Due to the further development of the invention a cyclic mode of operation of the facility becomes possible. While the processing chamber is being assembled from the upper part and the lower part, the second lower part, in the loading and unloading station, can be loaded or unloaded with an object. By these means, the stoppage time of the facility can be shortened. The transporting device can consist of a two-arm rotatable column, to the arms of which the lower parts are fastened.

The stoppage time can be shortened even more in accordance with an advantageous embodiment of the invention. While one object is being processed in the processing chamber, for example, with a blast of compressed air, a different object can be loaded in a loading station, and a cleaned object removed from the unloading station.

Pursuant to the invention, the transporting device is formed from a column, to the three or six arms of which the lower parts are attached. For a facility with two processing chambers, a column with three arms and lower parts can also be used. The extra lower part can be loaded and unloaded by a loading and unloading station. A four-arm column advantageously can be equipped with two processing chambers and separate loading and unloading stations or with three processing chambers and a common loading and unloading station.

In the case of an advantageous development of the invention, the two parts of the processing chamber can initially be moved independently of one another. While the one part carries out a movement with the transporting device in one movement position, the other part can carry out a movement relative to the movement plane of the part, which extends, for example, transversely to the first plane. These movements end in the stationary station in the working position of the processing chamber. By these means, a considerable shortening of the subsidiary times is achieved. Furthermore, in the case of the invention, the workpiece need be moved only in one movement position, for example, in a horizontal plane. It does not have to be raised or lowered. With that, even heavy workpieces can be handled easily. This leads to a simple construction of the transporting device and to a further shortening of the subsidiary times. Owing to the fact that the part for the seat for the workpiece is present in duplicate, the operating position of the processing chamber can be brought about with the one part in the stationary station and the loading and unloading with a workpiece can take place with the other part in the loading and unloading station, so that a further shortening of the subsidiary times is achieved by these means.

A further type of embodiment advantageously incorporates larger facilities in the invention, which provide for a multi-step surface processing, such as a washing step, a rinsing step and a drying step. In addition, there can be even other steps, such as a pre-washing step, a pre-rinsing step or a clean rinsing step. A separate processing chamber can be used for each processing step. Such a cleaning facility with many processing steps advantageously is provided for a final cleaning of objects in order, for example, to be able to supply a workpiece to a final installation. Due to the inventive, advantageous construction, the subsidiary times and, with that, the cycling times of a multi-chamber facility, can be shortened further because the workpieces, as they pass through the cleaning facility, do not have to be shifted in the sense that they are taken out of one processing chamber and placed in a different one. As a result, the transport through the cleaning facility is simplified even for heavy workpieces and, finally, the workpiece experiences the best possible care during transport through the cleaning facility.

A further type of embodiment of the invention is designed for larger facilities with three, four, five or even more processing chambers. In particular, the invention provides a transporting system for the workpieces, which works in a cycled mode. Moreover, stationary stopping stations are provided at the transporting segment of the transporting system. Advantageously, within the sense of the invention, divided processing chambers are used. Preferably, they consist of two separate parts, a tub-like lower part and a hood-shaped upper part. At the dividing edges, the two parts of the processing chambers have seals or are constructed with sealing surfaces, which interact with the seals and are constructed so that all upper parts of processing chambers fit together with all lower parts of processing chambers and can be exchanged for one another.

The upper parts of processing chambers are mounted at the stationary stopping stations of the transporting segment of the transporting system, preferably vertically above the transporting segment, and can be adjusted vertically. For this purpose, suspensions, at which the upper parts are suspended with lifting devices, are provided at the stationary stopping stations. As lifting devices, pneumatic or hydraulic cylinders can be used, the housings of which are permanently connected with the suspensions and the piston rods of which are connected to the fastening lugs of the upper sides of the upper parts.

The lower parts of processing chambers are connected with a transporting device, which can move the lower parts cyclically on the transporting segment. Advantageously, the lower parts are connected rigidly with the transporting system and are moved along a transporting segment specified by the transporting system. The transporting segment can be circular or straight.

At least one seat or one holding device for at least one object is built into the lower parts of processing chambers. The seat can be constructed so that it be can rotated or swivelled, so that the object can be moved during the processing with a processing medium, such as a cleaning liquid.

The lower parts and the upper parts of the processing chamber face one another with their open sides, so that upper parts and lower parts can be assembled in the stopping stations and transferred into the working stations. This is accomplished by actuating the lifting devices, which press the upper parts firmly onto the lower parts and bring about or assemble a hermetic connection in such a manner, that there is shielding from the environment.

In the working position of the processing chambers, the workpieces are processed with the processing medium. During the processing, the workpieces are moved, so that a good effectiveness of the processing medium is achieved all around.

Advantageously, a different surface treatment takes place in each processing chamber. For example, in a first processing chamber, the preliminary washing of the workpiece can be carried out. For this purpose, facilities are built into the upper part, the lower part or the upper part and the lower part. With these facilities, the processing chambers can be flooded with cleaning liquid. Coarse processing residues are removed in this liquid bath by the movement of the workpiece. Alternatively, spray nozzles can also be used, with which the cleaning liquid is sprayed onto the workpiece. A dry cleaning process, for which the workpiece is blasted with compressed air, can also be provided as a preliminary cleaning process.

In a further processing chamber, a final cleaning takes place. With this final cleaning, the workpiece is processed, for example, with a cleaning liquid under high pressure. At the same time, deburring of the workpiece may also take place. If it is formulated on an aqueous basis with surface active substances, the cleaning liquid may contain detergents and, if it is formulated on a hydrocarbon basis, it may contain solvents.

Preliminary rinsing can take place in a further processing chamber and the main rinsing by an immersion method as well as by a spraying method can take place in a subsequent processing chamber. Still-adhering residues of cleaning liquids can be freed from the workpieces here. Finally, in a further processing chamber, the workpieces can be dried. This can be accomplished by introducing a current of air, advantageously a current of warm air, of an installed radiant heating system, for example, infrared heating, or by vacuum drying. All of these types of processing are known and can be employed for the inventive construction of the cleaning facility. Of course, other methods of processing, such as steam cleaning or steam drying or super-clean rinsing, can also be provided. The number of processing chambers depends on the nature and extent of the processing steps. For each processing step desired, the invention permits stationary stations to be provided with processing chambers, for example, cleaning facilities with up to eight to ten stationary stations.

Workpieces are transferred from one station to the next cyclically and simultaneously. When the processing phases in the individual processing chambers are concluded, all units for operating the processing chambers are stopped, the processing medium is discharged from the processing chambers and, if necessary, pressure is equilibrated. The lifting devices can then be actuated and the upper parts separated from the lower parts, that is, lifted from the lower parts, so that the connection is severed. After that, the transporting system can be activated, so that all lower parts are transported with the workpieces to the next stationary station.

In this secured position, the upper parts at the stationary stations are then actuated and brought into the working position. This process is repeated until the workpieces have passed from the first station of the cleaning facility to the last station.

The loading and unloading of the lower parts with workpieces can take place at stopping stations. These are stopping stations for the lower parts, at which there are no upper parts at the transporting segment. This construction is particularly suitable for a circular or U-shaped transporting segment, the empty stations for loading and unloading being placed at the free ends of the legs of the U.

In the case of a transporting system, which is constructed as a circulating system, that is, which has a circular transporting segment, the loading and unloading stations can be inserted between two stationary stations with upper parts. For this purpose, the above-described empty stations are provided. In this case, the number of lower parts of the transporting system exceeds the number of upper parts at the stationary stopping stations by two, namely an empty station for loading and an empty station for unloading the workpieces. Advantageously, the two empty stations are directly next to one another.

Advantageously, the loading station and the unloading station can be connected to a manufacturing line for the workpieces, which is controlled in a fixed cycle operation. The workpieces can also be larger machine parts, such as engine blocks, which must be subjected to a cleaning operation, possibly with subsequent drying, after or between individual manufacturing steps, in order to remove adhering processing residues of an oil-containing or fat-containing nature, or solid metallic or non-metallic particles, such as shavings or chips. A circulating transporting device has the additional advantage that its integration into the manufacturing line does not result in a significant spatial elongation of the manufacturing line. Instead, it can be placed laterally offset next to the manufacturing line, in which case the manufacturing line is interrupted and the corresponding end section of the manufacturing line is connected functionally with the loading station and the corresponding starting section of the manufacturing line is connected with the unloading station. Removal from the manufacturing line and transfer to the cleaning facility and removal from the cleaning facility and transfer to the manufacturing line can be accomplished with suitable handling equipment or robots.

Advantageously, the transporting system is constructed as a one-column facility, which has arms or brackets, corresponding to the number of lower parts present. The arms or brackets protrude by the same length from the column and are disposed at equal distances from one another. The lower parts of processing chambers are connected to the free ends of the arms or brackets. Advantageously, at least one rail, on which the lower parts are supported by rollers, is laid concentrically around the column. With that, the forces, transferred by the upper parts, can be absorbed at least partially by the rails. The transporting system can be driven centrally over the column or by individual driving mechanisms of the rollers. Alternatively, the arms or brackets can be mounted movably at the column and swivelled up and down with lifting devices, in order to assemble the complete processing chamber.

In order to be able to move the workpieces during the individual processing phases, the seats for the workpieces in the lower parts can in each case be coupled with an external driving mechanism. For this purpose, driving mechanisms with coupling elements are mounted on each stationary stopping station with upper parts and connected in the inactive position of the lower parts with external coupling elements of the seats. This can be done automatically.

For disposing of processing medium or for blowing the processing medium out of the processing chambers, collecting containers can be mounted at the stationary stations with upper parts and the lower part has drain connections, which can be closed off and empties into the Collection container.

From the collecting containers, the processing medium such as the cleaning liquid, can be removed with a pipeline and fed once again to the processing chamber for processing the workpieces. Advantageously, this is done with interposing a purifying device.

BRIEF DESCRIPTION OF THE DRAWINGS

The invention is described in greater detail by means of examples illustrated in the drawings, in which.

DETAILED DESCRIPTION OF THE INVENTION

The cleaning facilities, shown diagrammatically in the Figures of the drawings, are intended for surface treatments, such as cleaning, flushing and drying industrial workpieces 1, for example, engine parts, such as engine blocks, transmission housings, cylinder heads, etc.

In the Figures of the drawings, only those components of the cleaning facility are shown, which are absolutely essential for an understanding of the invention. All other components may have a known structure and are therefore not described in greater detail. Identical functional parts have been provided with the same reference numbers in the Figures of the drawings.

Figure 1:
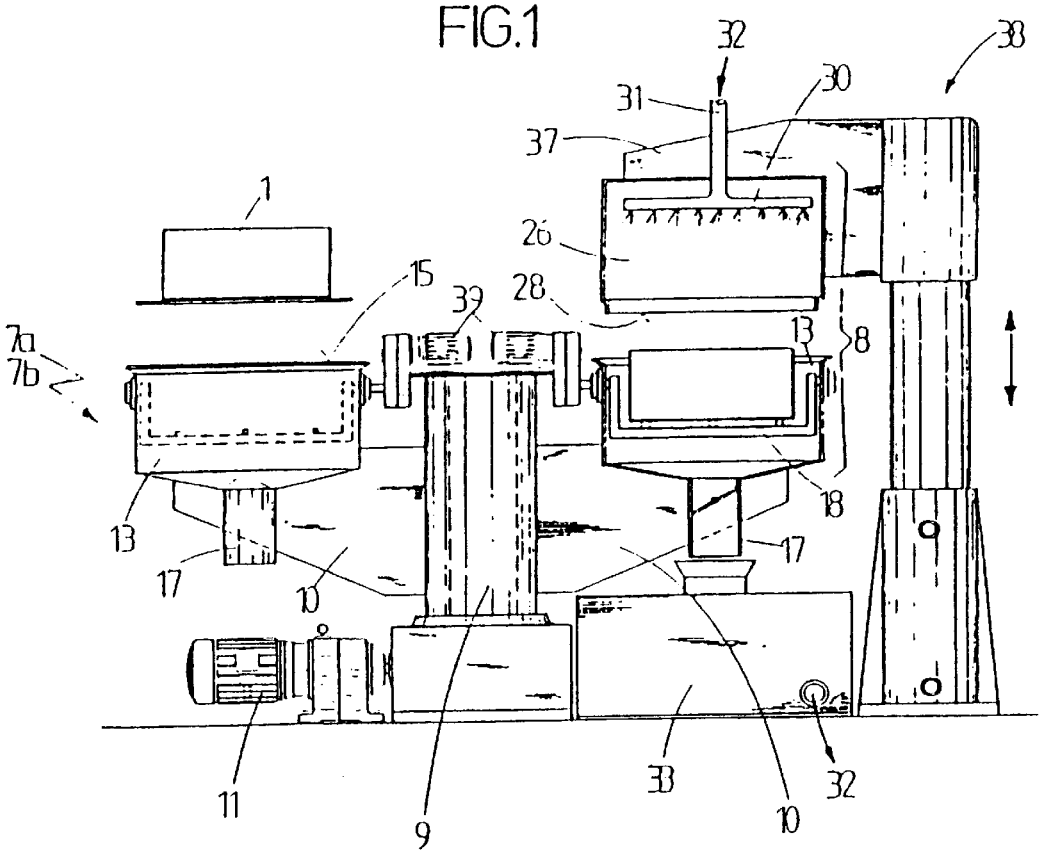
FIG. 1 shows a diagrammatic representation of a cleaning facility.

FIG. 1 of the drawings shows the diagrammatic representation of a compact cleaning facility with a processing chamber 8 for processing the workpieces 1, which can be assembled from parts 13; 26, which are shown in the opened position in FIG. 1. Of the parts 13; 26, part 26 is constructed as the upper part and part 13 as the lower part. The upper part 26 is fastened to a projecting arm 37 of a lifting device 38 and has built-in facilities 30 for supplying the processing medium. These facilities 30 can be spraying nozzles for spraying cleaning liquid or one or more air showers, with which the workpiece 1 is blasted with compressed air in the working position of the processing chamber 8.

The upper part 26 is rigidly fastened to the arm 37 and can be shifted with the lifting device 38 in the direction of the double arrow. The lifting device 38 is constructed as a gallows-like mast, which can be lengthened or shortened. The gallows-like mast can be a column, which can be adjusted hydraulically or pneumatically.

The lower part 13 of the processing chamber 8 is shown in FIG. 1 in a position, in which it is aligned with the upper part 26. When the lifting device 38 is actuated, the upper part 26 is lowered onto the lower part 13 and both parts are assembled into a complete processing chamber 8. The edges of upper part 26 and lower part 13 may have complementary sealing surfaces, which bring about a hermetic sealing of the processing chamber 8. A seat 18 for a workpiece 1 is built into the lower part 13. It is constructed so that it can be rotated or swivelled and is coupled with a driving mechanism 39 disposed at the transporting device 9; 10.

The transporting device 9; 10 consists of a column 9 with two diametrically projecting arms 10. The transporting device 9; 10 is coupled with a driving mechanism 11 and can be rotated. At each of the arms 10, a lower part 13, each with a seat 18, is fastened. Each seat 18 is coupled with a driving mechanism 39, which is located at the transporting device 9; 10. In FIG. 1, a position of the transporting device 9; 10 is shown, in which the lower part 13, as already mentioned, is in a position aligned with the upper part 26 and a further lower part 13 is brought into a loading and unloading position. In the region of the loading and unloading position, a loading and unloading station 7*a;* 7*b* is formed, where a workpiece 1 is inserted by a belt, which is not described further, such as a conveyor or a transporting belt of a manufacturing line, into the seat 18. When the processing of the workpiece 1 in the processing chamber 8 is concluded and the processing chamber is in the open position shown in FIG. 1, the workpiece can be inserted by the belt in the seat 18 and, subsequently, the transporting device 9; 10 turned through 180°. In the turned position, the untreated workpiece 1 from the belt is then in the closed position of the processing chamber 8 and the treated workpiece 1 from the processing chamber 8 is in the loading and unloading position and can be placed down on a further belt for removal. By actuating the lifting device 38, the processing chamber 8 can be closed and brought into the working position. In the bottom of the two lower parts 13 of the processing chamber 8, there is a drain connection 17 with a sealing cap, which is not shown. The used processing medium, such as the cleaning liquid, is discharged through the connection 17 into a collection tank 33, which is below the processing chamber 8 at the lifting device 38. The cleaning liquid can be supplied over pipeline 32 once again to the upper part 26, advantageously with interposing facilities for reprocessing the used cleaning liquid. The lower parts 13 of the processing chamber 8 can have the same construction.

Figure 2:
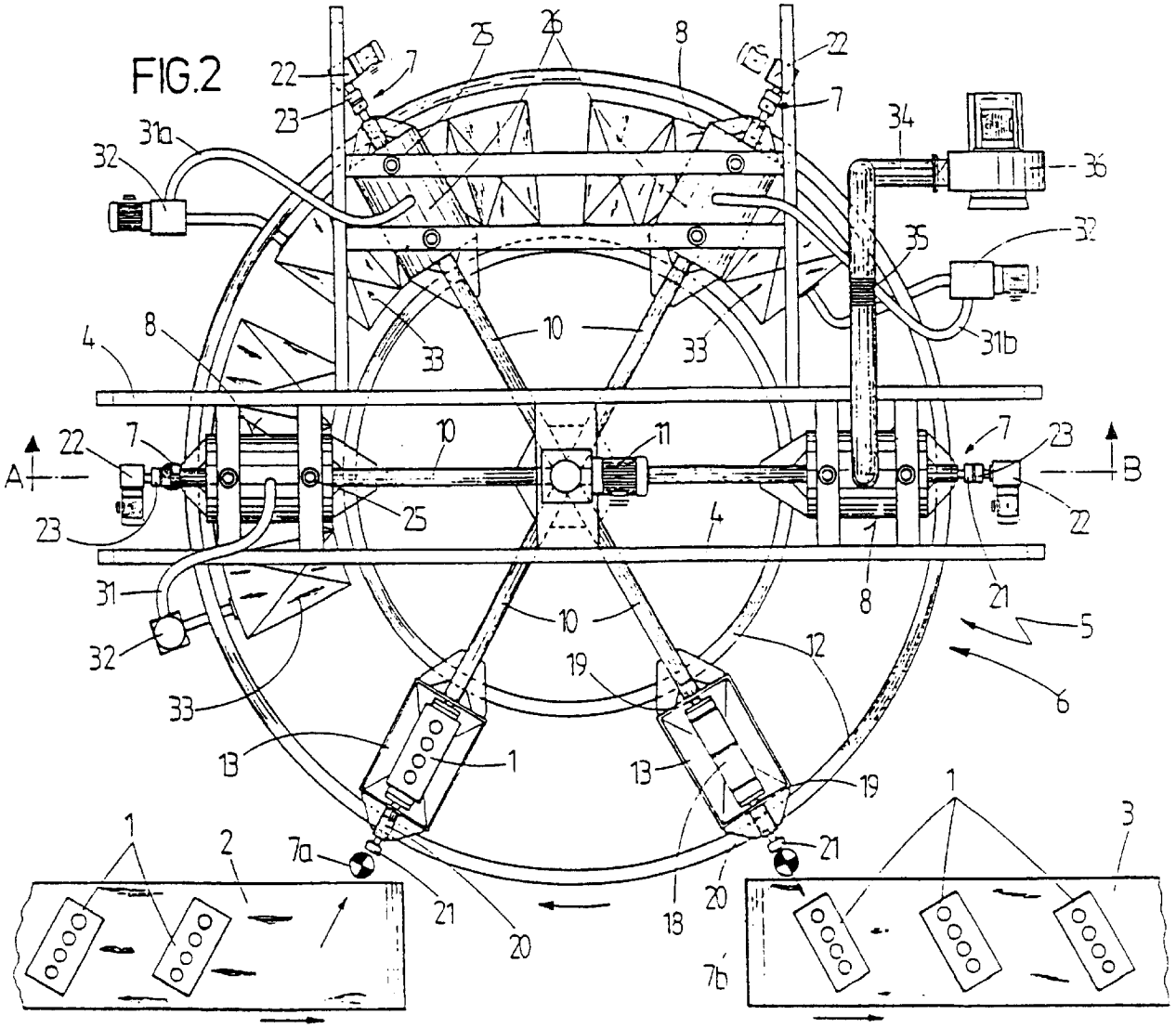
FIG. 2 shows a plan view of a different embodiment of the cleaning facility.
Figure 3:
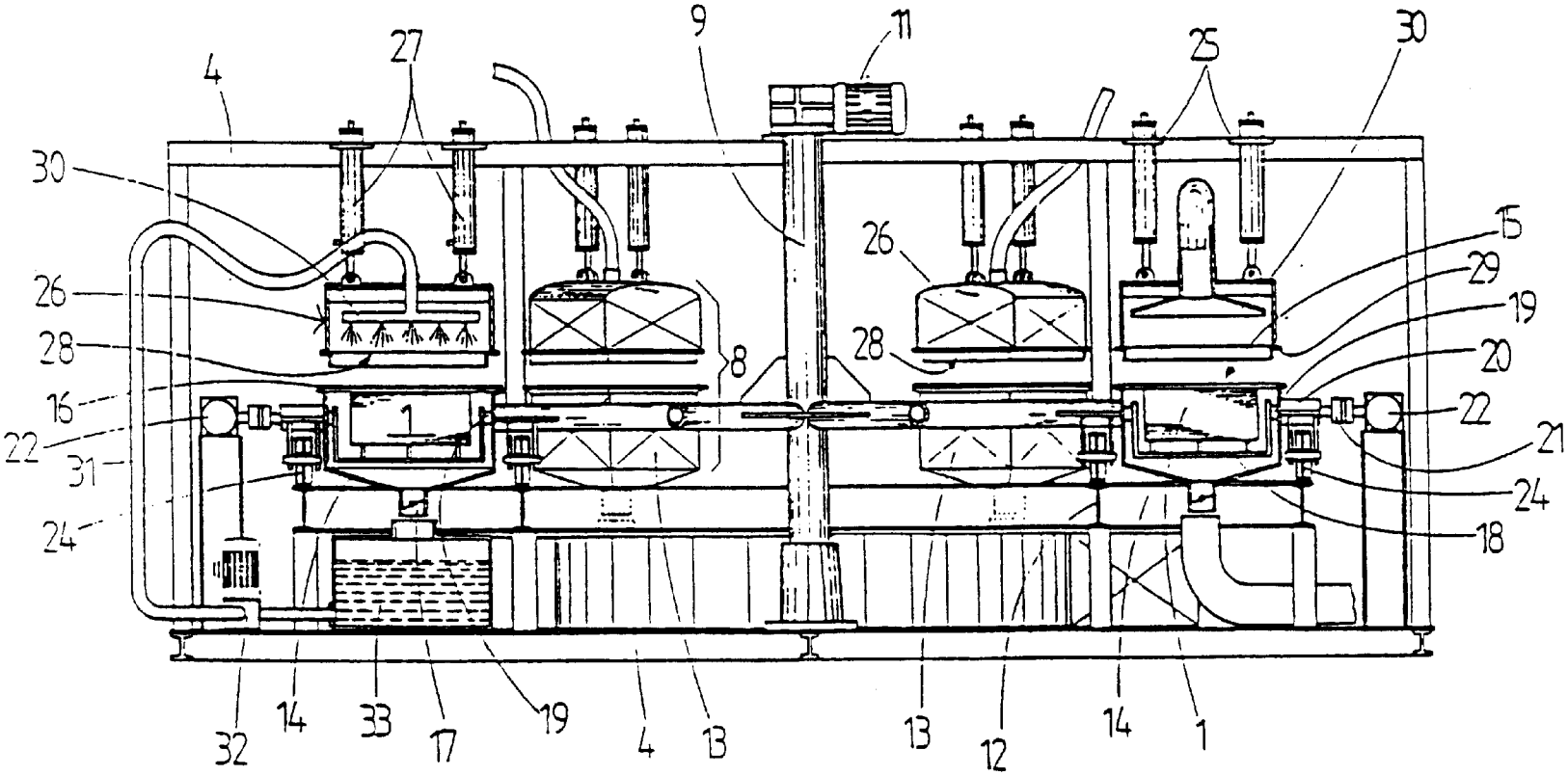
FIG. 3 shows a section through the cleaning facility along the line A-B of FIG. 2.

For the cleaning facility of FIGS. 2 and 3 of the drawings, the workpieces 1 from a finishing line, belt 2, are deposited with the help of handling equipment or robots, which are not shown, and inserted in the cleaning facility and, at the outlet of the cleaning facility, removed with the aforementioned handling equipment and returned to the production line, belt 3.

The individual components of the cleaning facility are attached or built onto a load-bearing rack construction 4. In particular, the cleaning facility consists a horizontal system 5 for the workpieces 1, which can be controlled in a cycled operating mode, and has stationary stopping stations 7 at the transporting segment 6 of the transporting system 5. Furthermore, there are four divided processing chambers 8, in which the individual processing steps are carried out.

As shown in FIG. 2, the transporting system 5 is intended for a circular transporting segment 6 and is constructed as a single column system. Six radially protruding arms 10 of equal length are disposed at an angle of 60° to one another at a rotatably mounted column 9. The latter is driven by a geared motor or a stepping motor 11. In the first case, the transporting steps or cycles are controlled by switching the motor on and off, for example, over limit switches. The transporting segment 6 consists of two rails 12, which are laid concentrically about the column 9 with a certain track width. The arms 10 are mounted at the column 9 at a functional particular height above the rails 12 and their free ends extend approximately up the inner rail 12.

Viewed from the center of the column 9, the stationary stopping stations 7 are disposed around the transporting segment 6. There is a total of six stopping stations 7, which lie in a plane of division that coincides with the six arms 10, so that all the arms 10 can be controlled precisely with each working cycle in a stopping station 7. There are four stationary stopping stations 7 for the surface processing of the workpiece 1 and two stations 7*a* for the loading and 7*b* for the unloading. Fewer or more stopping stations can be provided. The number of stopping stations 7 depends on the nature and extent of the processing steps.

At the front ends of the arms 10, the lower parts 13 of the processing chambers 8 are rigidly attached and reinforced by struts. All lower parts 13 can have the same structure. The lower parts 13 are constructed as open containers or tubs and each equipped with a bottom 14 and an open side 15, which is opposite to the bottom and has a straight edge, which forms a sealing surface 16. A drain connection 17 with a sealing cap, the details of which are not given, is disposed in the bottom 14. The processing medium can be discharged through the drain connection 17 in a manner, which will be described in greater detail below.

A seat 18 for the workpiece 1 is built into the lower part 13. The seat 18 has holding devices for the workpiece, the details of which are not given. The holding devices hold the workpiece 1 during the transport or during the processing.

As shown in FIG. 2, the seats 18 are built into the lower parts 13 in the extension direction of the arms 10 and have supporting legs, the details of which are not given and which extend parallel to and at a distance from the opposite side walls of the lower part 13 and are mounted rotatably in the lower parts 13 with two trunnions 19. For this purpose, there may be trunnion seats at the side walls of the lower parts 13, or the trunnions 19 may be taken through the side walls to the outside, forming a seal, and inserted and supported on the one hand, in a bearing at the end face of the arms 10 and, on the other, in a bearing seat 20 mounted outside at the side wall. The end of the trunnion 19 protrudes out of the trunnion seat 20 and has a coupling element 21. At each of the stopping stations 7, a stationary driving mechanism 22 with a coupling element, which fits the coupling element 21, is set up. The driving mechanism 22 can be coupled with the seats 18 in the stopping station 7 and can be caused to rotate or oscillate.

As shown in FIG. 3, the lower parts 13 at two opposite sides are supported by rollers 24 on rails 12. The track width of the rails 12 corresponds to the radial distance between the rollers 24. A roller 24 is supported at each end of the arms 10 and at the trunnion seats 20. For this purpose, roller suspensions are provided, the details of which are not described. The transporting system 5 also has a driving mechanism 11 for the lower parts 13 and, in the stopping stations 7, a driving mechanism 22 for each of the seats 18. The lower parts 13 can be transported step by step from station to station with the driving mechanism 11 and coupled, rotated or swivelled with the driving mechanism 11 for the seats 18.

Suspensions 25, to which the upper parts 26 of the processing chambers 8 are fastened, are present at the stopping stations 7 at the rack construction 4. The upper parts 26 are constructed as hoods and can be lowered and raised by the lifting devices 27. Pneumatic or hydraulic cylinders, which are fastened to the suspensions 25, function as lifting devices 27. As shown by FIG. 3, the upper parts 26 are connected with the hood roof to the lifting device 27 and, with their open sides 28, face the open sides 15 of the lower parts 13. Like the lower parts 13, the open sides 28 have straight edges, which have seals 29, which fit together with the sealing surfaces 16 of the lower parts 13. The parts 13; 26 fit together so well, that a watertight, spray watertight, droplet watertight, splashproof, airtight, dust-tight, pressure-tight or thermally insulating connection is brought about, depending on the requirements of the type of process, to which the workpieces 1 are subjected. The connection need fulfill only one but can fulfill all types of necessary tightnesses.

It is important that the parts 13; 26 fit together and supplement one another to form a complete cleaning chamber. In the stopping stations 7, the open sides 15; 28 of the lower parts 13 lie aligned with and opposite to the upper parts 26. Initially, the upper parts 26 are in a waiting position, which consists therein that, the distance between the lower parts 13 and the upper parts 26 is sufficiently large, so that a workpiece 1 can be inserted conveniently into the lower part 13 or that the workpiece 1, protruding over the edge of the lower part 13, does not collide with an upper part 26.

From the waiting position, the upper parts 26 can be lowered simultaneously by actuating the lifting devices 27 and assembled with the lower parts 13 and the working position of the processing chambers 8 can be brought about. Facilities 30 for supplying the processing medium are built into the upper parts 26. These facilities can be fittings, spraying nozzles for introducing a washing or rinsing liquid or for introducing a compressed air jet for dry cleaning or for introducing a current of air for drying, or electrical heaters, steam jets or vacuum suction valves and the like. As shown in FIG. 3, fittings for spraying a cleaning liquid are built into the upper part 26 of the left chamber 8. These fittings are connected over a pipeline 31 and a pumping station 32 to a collection tank 33 for the cleaning or rinsing liquid, which is stationed at the stopping station 7. According to FIG. 2, pumping stations 32 for other stopping stations 7 are also provided and connected over pipelines 31*a;* 31*b* with collection tanks 33. A variation, according to which the collecting tank 33 is connected over pipelines to recovery facilities for used cleaning or rinsing liquid, is not shown. The purpose of this variation is to refresh the cleaning or rinsing liquid in the collecting tanks 33 or to supply the recovered cleaning or rinsing liquid, coming from the recovery facility, directly once again to the processing chambers 8. As furthermore shown in FIG. 3, at least one device, constructed as an air shower 30 for drying the workpiece 1, is built into the right upper part 26 of the processing chamber 8. Over the air duct 34, the air shower 30 is connected over a heater 35 to a blower 36, which produces a current of air, with which the workpiece 1 is dried. The guiding channel 34, as well as the pipelines 31; 31*a;* 31*b* advantageously are flexible, in order to be able to compensate for the lifting motion of the upper part 26.

According to FIG. 2, the cleaning facility has a six-arm column 9 with a divisional scale of 60° with six lower parts 13 and four stationary stopping stations 7 with upper parts 26, which can be assembled with four lower parts 13 into complete processing chambers 8. Two empty stations 7*a;* 7*b* are provided, which do not have upper parts 26. The largest distance between two adjacent upper parts 26 here is three times the divisional scale (180°) of the six-arm column 9. The station 7*a* serves for loading the lower parts 13 with workpieces from the belt 2 and the station 7*b* serves for unloading the lower parts 13 onto the belt 3 of a manufacturing line. The loading and unloading stations 7*a;* 7*b,* adjacent to one another in one (60°) divisional scale of the six-arm column 9, are disposed separated from one another and in each case removed by one divisional scale (60°) from the next stationary stopping station 7.

The mode of operation of the cleaning facility is as follows. FIG. 2 shows a momentary state in the course of a processing cycle. A workpiece 1 has just been inserted from belt 2 into the lower part 13 at the loading station 7*a* and a workpiece 1 has just been placed at the unloading station 7*b* from the lower part 13 onto the belt 3. In the stopping stations 7, the processing of the workpieces 1 is concluded and the upper parts 26 are brought into the outlet positions. Any cleaning liquids, still present in the lower parts 13, are stored in the collection tanks 33. The driving mechanisms 22 are uncoupled. The column 9 is turned further in the direction of the arrow by one working cycle. The empty lower part of the unloading station 7*b* is then in the loading station 7*a,* the workpiece 1 from the loading station 7*a* is in the first stationary stopping station 7, in which a preliminary washing step takes place, the workpiece 1, previously in the first station 7, is now in the second stopping station 7, in which the main washing step takes place, the workpiece 1, previously in the second station 7, is now in the third stopping station 7, in which a rinsing step takes place, the workpiece 1, previously in third station, is now in the fourth stopping station 7, in which drying is carried out and the workpiece 1, previously in the fourth station, has now arrived in the unloading station 7*b*. This working cycle is completed and the lower part 13, now empty, can be loaded once again from belt 2 and a workpiece 1 from the unloading station 7*b* can be placed on belt 3.

What is claimed is:

1. An industrial cleaning facility for processing surfaces of workpieces with a processing medium, comprising:

at least one upper chamber part;

a number of lower chamber parts which is at least one more than a number of the at least one upper chamber part;

at least one processing chamber formed by aligning together respective open sides of the at least one upper chamber part and one of the number of lower chamber parts, the at least one chamber including facilities for supplying the processing medium;

a seat for at least one workpiece disposed in each of the lower chamber parts;

the at least one upper chamber part each being maintained disposed at a stationary station whereat the at least one processing chamber is formed for processing workpieces by aligning together respective open sides of the at least one upper chamber part and one of the number of lower chamber parts; and a transporting device for transporting the lower chamber parts between a loading and unloading station and the stationary station such that at least one of the at least two lower chamber parts is at the stationary station forming the at least one processing chamber while at least another one of the at least two lower chamber parts is at the loading and unloading station.

2. The industrial cleaning facility of claim 1, wherein:

the at least two lower chamber parts include three lower chamber parts which have seats for accepting workpieces;

the loading and unloading position includes a loading position and an unloading position; and the transport device positions the another one of the three lower chamber parts at the loading position and while positioning yet another one of the three lower chamber parts at the unloading position.

3. An industrial cleaning facility for processing surfaces of workpieces with a processing medium, comprising:

several upper chamber parts;

a number of lower chamber parts which is at least one more than a number of the upper chamber parts;

several processing chambers, each of the several processing chambers formed by aligning together respective open sides, which fit together, of the several upper chamber parts and ones of the number of lower chamber parts, at least one of the processing chambers including facilities for supplying the processing medium;

the lower chamber parts having built-in seats for in each case at least one workpiece;

a transporting device for transporting the lower chamber parts between a loading and unloading station and stationary stations, the lower chamber parts being fastened at equal distances from one another on the transporting device and transported simultaneously and stepwise;

the upper chamber parts being mounted and maintained on the stationary stations each of which is maintained disposed on a fixed transporting segment of the transporting device;

the lower chamber parts being transported by the transporting device so as to be moved into positions aligned with the upper chamber parts mounted at the stationary stations and thus transferred into working positions of the processing chambers;

a number of the lower chamber parts, transported by the transporting device, exceeding by at least one a number of the upper chamber parts disposed at the stationary stations, and the transport device transporting the lower chamber parts such that several of the lower chamber parts are at the stationary stations forming the several processing chambers while remaining ones of the lower chamber parts are stopped at the loading and unloading station.

4. The industrial cleaning facility of claim 1, wherein the seats are constructed to be rotated or swivelled.

5. The industrial cleaning facility of claim 1 or 2, wherein the at least one upper chamber part is shifted at least with respect to height in relation to the lower chamber parts to form the at least one processing chamber.

6. The industrial cleaning facility of one of the claims 1 and 2, wherein the facilities for supplying the processing medium are built into the at least one upper chamber part.

7. The industrial cleaning facility of one of the claims 1 and 2, wherein a plane of division of forming the at least one processing chamber extends horizontally.

8. The industrial cleaning facility of one of the claims 1 and 2, wherein the lower chamber parts are tub shaped and the at least one upper chamber part is a hood disposed at the stationary station.

9. The industrial cleaning facility of claim 1, wherein the lower chamber parts are constructed identically.

10. The industrial cleaning facility of claim 3, wherein the number of the lower chamber parts transported with the transporting device exceeds by two the number of the upper chamber parts of the processing chambers at the stationary stations and the loading and unloading station includes a loading station and an unloading station whereat two of the lower chamber parts not forming the processing chambers are transported to.

11. The industrial cleaning facility of claim 3 or 10, wherein the stationary stations are two in number and support the upper chamber parts, of the several processing chambers, which are aligned with the lower chamber parts to form the several processing chambers at the stationary stations of the transporting device.

12. The industrial cleaning facility of claim 3 or 10, wherein the stationary stations are three stationary stations, each with ones of the upper chamber parts for forming the processing chambers, and the lower chamber parts are five lower chamber parts.

13. The industrial cleaning facility of claim 3 or 10, wherein the stationary stations are four in number each with ones of the upper chamber parts and act together with the lower chamber parts which are six in number.

14. The industrial cleaning facility of claim 1, wherein the transporting device is constructed as a circulating transporting device.

15. The industrial cleaning facility of claim 1, wherein the transporting device has the lower chamber parts attached to projecting arms extending from a column.

16. The industrial cleaning facility of claim 1, further comprising facilities for discharging the processing medium built into the lower chamber parts.

17. The industrial cleaning facility of claim 1, further comprising collection tanks for the processing medium disposed at the at least one stationary station.

18. The industrial cleaning facility of claim 17, wherein the collection tanks connected via pipelines to the at least one upper chamber part for collecting and supplying the processing medium.

19. The industrial cleaning facility of claim 17, wherein the collection tanks are connected via pipelines with recovery facilities for the processing medium once used.

20. The industrial cleaning facility of claim 1, wherein the lower chamber parts transported by the transporting device are in each case supported by at least one roller device.

21. The industrial cleaning facility of claim 20, wherein the rolling devices are guided on a rail disposed concentrically about a column from which the upper chamber parts are supported.

22. The industrial cleaning facility of claim 1, wherein the seats are built into the lower chamber parts and, in each case, coupleable with a driving mechanism disposed in the at least one stationary station.

23. The industrial cleaning facility of claim 1, wherein the at least one upper chamber part is fastened to a projecting arm of a lifting device for forming the at least one processing chamber.

24. The industrial cleaning facility of claim 1, wherein the seats are coupled with in each case one driving mechanism disposed at the transporting device.

25. The industrial cleaning facility of claim 3, wherein the seats are constructed to be rotated or swivelled.

26. The industrial cleaning facility of claims 3 or 10, wherein the several upper chamber parts are shifted at least with respect to height in relation to the lower chamber parts to form the several processing chambers.

27. The industrial cleaning facility of one of the claims 3 and 10, wherein the facilities for supplying the processing medium are built into the several upper chamber parts.

28. The industrial cleaning facility of one of the claims 3 and 10, wherein a plane of division of forming the several processing chambers.

29. The industrial cleaning facility of one of the claims 3 and 10, wherein the lower chamber parts are tub shaped and the several upper chamber parts are hoods disposed at the stationary stations.

30. The industrial cleaning facility of claim 1, wherein the lower chamber parts are constructed identically.

31. The industrial cleaning facility of one of the claims 3 or 10, wherein the transporting device is constructed as a circulating transporting device.

32. The industrial cleaning facility of one of the claims 3 or 10, wherein the transporting device has the lower chamber parts attached to projecting arms extending from a column.

33. The industrial cleaning facility of one of the claims 3 or 10, further comprising facilities for discharging the processing medium built into the lower chamber parts.

34. The industrial cleaning facility of one of claims 3 or 10, further comprising collection tanks for the processing medium disposed at the stationary stations.

35. The industrial cleaning facility of claim 34, wherein the collection tanks connected via pipelines to the upper chamber parts for collecting and supplying the processing medium.

36. The industrial cleaning facility of claim 34, wherein the collection tanks are connected via pipelines with recovery facilities for the processing medium once used.

37. The industrial cleaning facility of one of the claims 3 or 10, wherein the lower chamber parts transported by the transporting device are in each case supported by at least one roller device.

38. The industrial cleaning facility of claim 37, wherein the rolling devices are guided on a rail disposed concentrically about the column from which the upper chamber parts are supported.

39. The industrial cleaning facility of one of claims 3 and 10, wherein the seats are built into the lower chamber parts and, in each case, coupleable with a driving mechanism disposed in the stationary stations.

40. The industrial cleaning facility of any one of claims 3 and 10, wherein the upper chamber parts are fastened to a projecting arm of a lifting device for forming the processing chambers.

41. The industrial cleaning facility of one of the claims 3 or 10, wherein the seats are coupled with in each case one driving mechanism disposed at the transporting device.

42. An industrial cleaning facility for processing workpieces with a processing medium, comprising:

at least one upper chamber part maintained at a stationary station;

at least two lower chamber parts for accepting at least one workpiece apiece, wherein a total number of said lower chamber parts exceeds a total number of said upper chamber parts by at least one;

said lower chamber parts being engageable with and separable from the at least one upper chamber part so as to form at least one processing chamber when engaged with ones of said at least one upper chamber part;

an application device for applying said processing medium being disposed in said at least one processing chamber;

a transport mechanism for moving the at least two lower chamber parts between a loading and unloading position and a processing position, said processing position being at said at least one stationary station; and an engaging device disposed at said at least one stationary station for supporting said at least one upper chamber part and engaging said at least one upper chamber part with each of said at least two lower chamber parts when ones of said at least two lower chamber parts are respectively transported to the cleaning position.

43. The industrial cleaning facility of claim 42, wherein:

the at least two lower chamber parts include three lower chamber parts, the total number of the lower chamber parts exceeding the total number of the at least one upper chamber part by at least two;

the loading and unloading position includes both a loading position and an unloading position; and the transport device positions the another one of the at least three lower chamber parts at the loading position and while positioning yet another one of the at least three lower chamber parts at the unloading position.

44. The industrial cleaning facility of claim 42 or 43, wherein the engaging device shifts the at least one upper chamber part vertically in relation to the lower chamber parts to form the at least on e processing chamber.

45. The industrial cleaning facility of claim 42 or 43, wherein the at least one upper chamber part includes several upper chamber parts with an engaging device provided for each to form several processing chambers.

* * * * *